US005890239A

United States Patent [19]

Hite

[11] Patent Number: 5,890,239

[45] **Date of Patent: *Apr. 6, 1999**

[54] METHOD OF RESEATING A TOILET

[75] Inventor: Mike Hite, Lynwood, Calif.

[73] Assignee: Pasco Specialty & Mfg. Co., Lynwood, Calif.

[ * ] Notice: Under 35 U.S.C. 154(b), the term of this patent shall be extended for 662 days.

[21] Appl. No.: 496,628

[22] Filed: Jun. 29, 1995

[51] Int. Cl.[6] ..... E03D 11/16

[52] U.S. Cl. ..... 4/252.5; 285/56

[58] Field of Search ..... 4/252.4, 252.5; 285/56

[56] References Cited

U.S. PATENT DOCUMENTS

| | | | |
|---|---|---|---|
| 1,613,926 | 1/1927 | Bropson | 285/56 |
| 4,207,630 | 6/1980 | Bressler | 4/252.4 |
| 4,780,915 | 11/1988 | Cuschera | 4/252.4 |
| 4,873,730 | 10/1989 | Cuschera | 4/252.4 |
| 4,886,302 | 12/1989 | Forbes | 4/252.4 X |
| 5,246,255 | 9/1993 | Forbes et al. | 4/252.1 X |
| 5,492,372 | 2/1996 | Dranberg | 4/252.4 X |

*Primary Examiner*—Robert M. Fetsuga

*Attorney, Agent, or Firm*—Charles H. Thomas

[57] ABSTRACT

A method of reseating a toilet seat employs a flat, rigid member arcuately curved to conform to the outer circumference of a toilet sewage drain. The flat member has a plurality of anchor fastening openings therethrough as well as at least one elongated closet bolt slot. The member is utilized to reseat a toilet atop the upper extremity of a toilet drain when the closet flange originally utilized in seating the toilet has broken, deteriorated, or corroded. According to the method a closet bolt is inserted into the closet bolt slot in the flat member such that the closet bolt head bears against the structure of the flat member and the closet bolt shank projects upwardly therefrom. With the toilet removed from atop the drain, the flat member is placed on the floor adjacent the upper extremity of the drain and secured to the floor by means of a plurality of anchor fasteners. The anchor fasteners extend into the floor through at least some of the anchor fastener openings. A conventional sealing ring is positioned beneath the toilet and the toilet is remounted atop the upper extremity of the drain with the closet bolt shanks projecting upwardly through openings in the toilet base. Closet bolt nuts are then tightened onto the distal ends of the closet bolt shanks to reseat the toilet atop the flat member which provides support for the closet bolt head.

14 Claims, 8 Drawing Sheets

METHOD OF RESEATING A TOILET

BACKGROUND OF THE INVENTION

1. Field of the Invention

The present invention is directed to a method for reseating a toilet atop a drain from which at least a portion of the closet flange is missing.

2. Description of the Prior Art

In the installation of a conventional plumbing system for a toilet the vertical toilet sewage drain pipe beneath the toilet extends upwardly into an opening in the floor and terminates in a water closet coupling. The water closet coupling typically includes a tubular sleeve that encircles the upper extremity of the drain pipe and also a radially outwardly projecting annular closet flange. The closet flange is provided with a plurality of apertures. These typically include a pair of elongated, arcuately shaped slots each having a widened region through which a closet bolt head will pass and an adjacent narrower region having a dimension sufficient to admit passage of the shank of a closet bolt, but not the head. Closet bolts are inserted through the closet bolt slots and are moved laterally within the slots into vertical alignment with closet bolt openings in the base of a toilet. The shoulders formed by the closet bolt heads bear upwardly against the underside of the closet flange adjacent the edges of the narrower portions of the closet bolt slots, while the shanks of the closet bolts project upwardly through the narrower portions of the closet bolt slots.

To seat a toilet, a sealing ring, typically a wax ring having a generally toroidal shape is mounted on the exterior surface of the portion of the drain depending from the bottom of the toilet bowl. The closet bolts are moved along the closet bolt slots in the closet flange until they are in vertical alignment with the closet bolt openings in the base.

The toilet is then lowered vertically downwardly toward the water closet coupling until the peripheral margin of the toilet base rests upon the floor and the shanks of the closet bolts project upwardly through the closet bolt openings in the toilet base. Fender washers are first placed upon the exposed distal ends of the shanks of the closet bolts to provide a sufficient bearing surface to accommodate closet bolt nuts which are then threadably engaged onto the distal, upwardly projecting extremities of the closet bolts. The nuts are thereupon tightened to compress the sealing ring so as to seal the sealing ring to the toilet bowl and to the upper extremity of the drain and to firmly seat the toilet base upon the floor. Once the installation of a toilet is complete, the toilet base will not move relative to the floor and a firm, fluid-tight seal is established between the toilet and the extremity of the drain pipe.

For many years water closet couplings were formed of cast iron because toilet drain sewage pipes were likewise formed of cast iron. The use of the same materials allowed cast iron water closet couplings to be welded to cast iron drainage pipes. In recent times, however, the use of plastic drainage pipes has become much more prevalent. Plastic drain pipes are advantageous in that they are much lighter in weight than cast iron pipes, and can be solvent welded together with considerably greater ease than welding operations required to join sections of cast iron pipe together.

Because most building plumbing drainage piping now being installed is formed of plastic, the structure of water closet couplings has also changed. Specifically; the structural composition of many recent models of closet flanges employs a plastic sleeve about the upper end of the toilet drain pipe surrounded by a very thin painted steel flange. Since plastic is more flexible than iron or steel, it is still necessary for the radial closet flange to be formed of metal. Therefore, most water closet couplings manufactured for new plumbing installations are formed of plastic tubular sleeves having radially outwardly directed annular channels defined near their upper extremities with radially outwardly projecting steel closet flanges mounted in these channels. These flanges are longitudinally restrained by the structure of the outer surface of the plastic sleeve, but are freely rotatable relative thereto. The steel closet flanges provide sufficient structural rigidity to accommodate the closet bolt installation previously described and allow a toilet to be firmly seated and securely fastened to the upper extremity of a toilet drain pipe.

However, even though conventional steel closet flanges are painted for protection against corrosion, not infrequently the paint will become scratched, sometimes before and sometimes during installation. It has been found that even a very small scratch in the paint on a steel closet flange can lead to rapid rusting and structural deterioration of the closet flange throughout its entire circumference. When the areas of the structure of the closet flanges rust and crumble at the locations at which the closet bolt heads bear upwardly there against, the heads of the closet bolts pull through the deteriorated openings of the closet bolt slots.

The structure of such plastic and steel closet flanges is such that they rapidly deteriorate due to rusting if their protective layer of paint is scratched even slightly so as to provide the flange with an exposure to moisture. Indeed, even small scratches on the closet ring rims of such closet flanges which are legally employed in many areas of the country cause the rims of the flanges to rust and disintegrate relatively rapidly to the point where there is practically no structure of the rim left against which the heads of the closet bolts can bear. When this occurs the toilet bowl is no longer tightly held to the floor, since the structural integrity of the closet flange rim has deteriorated so greatly. Indeed, in many toilet flanges the rim deteriorates far beyond the immediate vicinity of the openings or slots defined therein through which the shanks of the closet bolts project. Indeed, large arcuate sections of the rim of the closet flange, and often the entire rim, will disintegrate and crumble apart due to rusting action.

When one of the closet bolts loses its bearing surface against the underside of the closet ring, the toilet will tend to rock and can twist on the floor. Seating on the toilet therefore becomes unsound, and the seal between the toilet drain and the toilet drain pipe formed by the sealing ring can become broken as well. When this occurs, it is necessary to repair this connection and reseat the toilet.

One system which was devised for this purpose is described in U.S. Pat. No. 4,207,630. That patent describes a spanner clamp that is used to provide a missing bearing surface when a portion of a toilet closet flange has broken away. According to the practice described in that patent, a slotted flat metal member, shaped generally in the form of an arcuate metal strip, is provided to span the gap that is left when only a portion of an annular water closet flange has broken away. In such a situation there is still enough structure left of the original water closet flange on either side of the broken away portion to provide a bearing surface for the ends of the spanner strip.

To use this system the spanner strip must first be positioned beneath the level of the original water closet flange. The shank of a closet bolt is inserted through the slot in the spanner strip and directed upwardly through the gap left by the broken away portion of the water closet flange. The ends of the spanner strip bear upwardly against the undersides of the remaining structure of the original closet flange on either side of the gap left therein when a portion of the closet flange has been broken away.

One significant problem with the system of U.S. Pat. No. 4,207,630 is that the system only works if there is sufficient structure left from the original closet flange to provide adequate surfaces against which the ends of the spanner strip can bear. While cast iron closet flanges will sometimes fail by loss of only a relatively narrow sector of material, the same is not true of the steel closet flanges that are now employed to such a wide extent with plastic drain pipe. Unlike cast iron flanges, the steel flanges that are widely utilized with plastic drain pipes fail not so much by fracture and the loss of a relatively narrow, arcuate sector of material, but more typically by complete or nearly complete disintegration due to rust and corrosion. As a consequence, in the failure of a steel closet flange now utilized in most modern plumbing installations, there is very little material left to provide any type of bearing surface to accommodate a spanning strip of the type described in U.S. Pat. No. 4,207,630.

As a result, it has heretofore been necessary to remove and replace the entire water closet coupling of a composite plastic steel water closet coupling when failure of the steel closet flange occurs. However, it is extremely difficult to remove the plastic sleeve of such a water closet coupling from the plastic upper extremity of a drain pipe. Furthermore, the area in which this work must be carried out is below the floor level, so that there is often inadequate room for manipulation of tools and insufficient space to accommodate the hands of the plumber to perform the tasks necessary. As a consequence, the replacement of composite steel and plastic water closet couplings has heretofore been inordinately time consuming and expensive.

SUMMARY OF THE INVENTION

A primary object of the present invention is to provide a method for reseating a toilet and resealing the drain of the toilet to a toilet sewer drain line when a major portion or even the entire structure of an original closet flange is missing. The method of the present invention does not rely upon the use of any structure of the original closet flange in order to successfully reseat a toilet. Nevertheless, the method of the present invention can be utilized even when a substantial portion of the original closet ring does remain.

A further object of the present invention is to provide a toilet reseating system which does not require any structure to be inserted beneath the level of the original closet flange. In many installations the opening defined in the floor for the closet flange is quite narrow and the upper extremity of the drain pipe may emerge closely adjacent to building structures, such as walls or joists, that render it difficult if not impossible to insert any repair article underneath the remaining portion of a pre-existing closet flange. Unlike the system of U.S. Pat. No. 4,207,630, the present invention allows for all manipulation of parts and tools to be performed above the level of the closet flange. Thus, problems of trying to insert articles beneath the remnants of a pre-existing closet flange and into narrow spaces between the drain pipe and adjacent building structures are avoided.

A further object of the present invention is to provide a toilet reseating system which does not rely upon the structural integrity of any portion of an original closet flange. Indeed, when closet flanges deteriorate or fracture only partially, the structure remaining is often weakened as well. The system of the present invention avoids relying upon weakened remnant structures.

In one broad aspect the present invention may be considered to be a method of reseating a toilet having a base with closet bolt openings therein on a floor atop an upper extremity of a drain from which at least a portion of a radially projecting closet flange is missing. The method of the invention utilizes a conventional sealing ring, and at least one closet bolt having an enlarged head at one end with a shank projecting therefrom to terminate in a distal end and a closet bolt nut engageable with the distal end of the shank. A plurality of anchor fasteners are also required.

A very important structure utilized in the reseating system of the invention is a flat, rigid member arcuately curved to conform to the outer circumference of the drain and having a plurality of anchor fastening openings therethrough as well as at least one elongated closet bolt slot. The method of the invention is comprised of the following steps. A closet bolt is inserted into the closet bolt slot such that the closet bolt head bears against the structure of the flat member and the closet bolt shank projects through the closet bolt slot. The flat member is placed on the floor adjacent the upper extremity of the drain such that the closet bolt shank projects upwardly.

The flat member is then secured to the floor by means of a plurality of anchor fasteners that extend into the floor through at least some of the anchor fastener openings.

The sealing ring is then positioned beneath the toilet. The position of each closet bolt is laterally adjusted within the confines of the closet bolt slot such that the closet bolt shank resides in registration with and will project upwardly through one of the closet bolt openings in the toilet base. The toilet is mounted atop the upper extremity of the drain. The closet bolt nut is then tightened down onto the distal end of the closet bolt shank to thereby exert a compressive force on the sealing ring to seal the sealing ring to the toilet and to the upper extremity of the drain.

The flat rigid member employed in the method of the invention may take several forms. It may be comprised of one or more relatively narrow, arcuate strips die cut to extend over an arc of 180 degrees. Alternatively, the flat member may be formed as a stamped, flat, annular structure, completely open at the center, but shaped as a flat, encircling ring.

When the flat member is formed as a metal strip extending over an arc of approximately 180 degrees, it can be used to provide a means for mounting a closet bolt on one side of a toilet base when only one of the pair of closet bolts has become disengaged from the drain due to loss of structure of the closet flange. On the other hand, another, identical flat slab or strip can be utilized to provide support for the closet bolt on the other side of the base, if that is necessary. The annular version of the flat, rigid member is designed to provide structural support for both closet bolts that are conventionally utilized to seat a toilet.

Whatever form the flat, floor attachment member takes, it is preferably constructed so that the closet bolt slot and at least some of the anchor fastener openings are located at a common radial distance from the upper extremity of the drain. This provides a means by which some of the anchor fasteners may be secured to the floor at the same radial distance from the upper extremity of the drain as the closet bolt and in angular displacement therefrom. On the other hand, the flat member is also preferably fabricated with radially projecting ears in which at least some of the fastener openings are defined. This allows at least some of the anchor fastener openings to be located in the flat member at a greater radial distance from the upper extremity of the drain than the closet bolt slot. In this way at least some of the anchor fasteners can be secured to the floor at locations more distant from the upper extremity of the drain than the location of the closet bolt.

The flat member may be secured in position relative to the floor in several ways. It may be placed to occupy a position previously occupied by at least a portion of the closet flange. That is, where at least half of the closet flange is missing, a flat member of semicircular configuration can be positioned in the space no longer occupied by the missing half of the closet flange. Where the entire closet flange is missing, the space may be occupied by two identical, semicircular flat members of the type described, or by a single flat ring-shaped member.

The flat, rigid member employed according to the method of the invention is designed to fit into the space that has been left vacant by the disintegrated closet flange of a composite plastic and steel closet ring. It is not designed to bear upwardly against the closet flange rim, but rather to replace the closet flange rim.

To utilize this closet flange replacement device, a plumber will insert a closet bolt into the underside of the arcuate slot defined within the structure thereof. The flat member is then positioned in contact with the floor surrounding the upper end of the drain in place of the closet flange rim, which no longer exists. If any structure of the original steel closet flange is left the plumber will normally beat it away with a hammer or pull it out away from the plastic sleeve with pliers or some other implement so that the flat replacement member can be positioned flush against the floor. The ends of the flat member are then secured through the circular openings defined therein to the floor by means of wood screws or concrete anchors.

Since the flat member used in the practice of the invention resides in the space previously occupied by the closet flange rim, the closet bolts will reside at the same radial distance from the center of the closet flange as the opening in the base of the toilet bowl. Therefore, the closet bolts can be moved along the arcuate slots defined in the flat member until they reside in axial alignment with the openings in the base of the toilet bowl. A washer and a retaining nut are then fastened onto the end of each closet bolt that protrudes above the toilet bowl base mounting flanges to thereby secure the toilet bowl to the floor.

In some situations the original steel rim of the closet flange may not be so thoroughly deteriorated as to be easily removable. In this case the plumber will attempt to flatten down the remaining portion of the original closet ring rim with a hammer and will then place the flat member used in the practice of the invention on top of, not underneath, the flattened remnant of the original closet flange rim. The flat member is then fastened to the floor from above.

When the flat member utilized in reseating a toilet according to the invention is placed atop a remnant portion of the closet ring, it is advisable to apply a bead of caulking to the flat member on the side thereof facing toward the floor. The caulking serves to provide a seal between the underside of the flat member and the remnant portion of the closet ring so as to prevent any leakage at that juncture and to avoid the emission of noxious odors.

The flat, slotted member employed in the invention is preferably formed of die cut or stamped, flat steel stock about one-eighth of an inch in thickness. To prevent its corrosion it is preferably covered with a corrosion resistant coating, such as plastisol, prior to use. The coating process may be performed by dipping the stamped metal part in plastisol.

In one advantageous implementation the present invention may be considered to be a method of reseating a toilet having a base with closet bolt openings therein on a floor atop an upper extremity of a drain from which at least a portion of a radially projecting closet flange is missing. The implementation of the method utilizes a sealing ring; a pair of closet bolts, each having an enlarged head at one end with a shank projecting therefrom to terminate in a distal end; and a pair of closet bolt nuts engageable with the distal ends of the shanks. A plurality of anchor fasteners are also employed. The system also utilizes a flat, rigid annular member arcuately curved to conform to the outer circumference of the drain and having a plurality of anchor fastener openings therethrough as well as a pair of elongated closet bolt slots defined therein.

The preferred implementation of the method of the invention is comprised of the steps of: inserting the closet bolts into the closet bolt slots such that the closet bolt heads bear against the structure of the flat member and the closet bolt shanks project through the closet bolt slots, placing the flat member atop the floor to encircle the upper extremity of the drain and such that the closet bolt shanks project upwardly, and securing the flat member to the floor by means of a plurality of anchor fasteners that extend into the floor through at least some of the anchor fastener openings.

The sealing ring is then positioned beneath the toilet. The toilet is mounted atop the upper extremity of the drain while laterally adjusting the position of the closet bolts such that the closet bolt shanks reside in registration with and project upwardly through the closet bolt openings in the base. Closet bolt nuts are then tightened down onto the distal ends of the closet bolt shanks to thereby exert a compressive force on the sealing ring to seal the sealing ring to the toilet and to the upper extremity of the drain. Flange washers are preferably installed on the distal ends of the closet bolt shanks before the closet bolt nuts are engaged with the closet bolt shanks.

The system of the present invention may be utilized not only on solvent welded plastic and steel combination water closet couplings, as heretofore described, but also as attachments to cast iron rings from which peripheral portions have been broken away. In this aspect the invention may be considered to the a method of securing a water closet having closet bolt openings therein to a drain, the upper extremity of which has a broken water closet flange at least a portion of which remains intact. This aspect of the invention utilizes an annular sealing ring and at least one arcuate, curved, rigid, flat replacement member formed in the shape of at least a portion of a water closet flange and having at least one elongated, enclosed slot therein, at least one closet bolt having an enlarged head and a shank projecting therefrom and terminating at a distal end, and at least one closet bolt nut engageable with the distal end of the closet bolt shank.

According to the invention the closet bolt is inserted into the elongated slot such that the closet bolt head bears upwardly against the flat replacement member from beneath. The closet bolt shank projects upwardly through the closet bolt slot. The flat replacement member is positioned atop the portion of the broken water closet flange that remains intact and adjacent the upper extremity of the drain. The closet bolt shank projects upwardly from the flat replacement member. The flat replacement member is secured to the portion of the water closet flange remaining intact with anchor fasteners that project through the water closet fastener openings therein and into the portion of the water closet flange remaining intact. This is done by first drilling holes in any remaining portion of the water closet flange that reside in corresponding alignment with holes in the flat replacement member.

The sealing ring is then positioned beneath the water closet. The water closet is mounted atop the flat replacement member while adjusting the position of the closet bolt along the elongated slot so that the distal end of the closet bolt shank projects upwardly and protrudes through one of the closet bolt openings in the water closet. A closet bolt nut is then tightened down onto the distal end of the closet bolt shank thereby compressing the sealing ring to seal it to the upper extremity of the drain and to the water closet.

The invention may be described with greater clarity and particularity by reference to the accompanying drawings.

DESCRIPTION OF EXEMPLARY IMPLEMENTATIONS OF THE METHOD OF THE INVENTION

Figure 1:
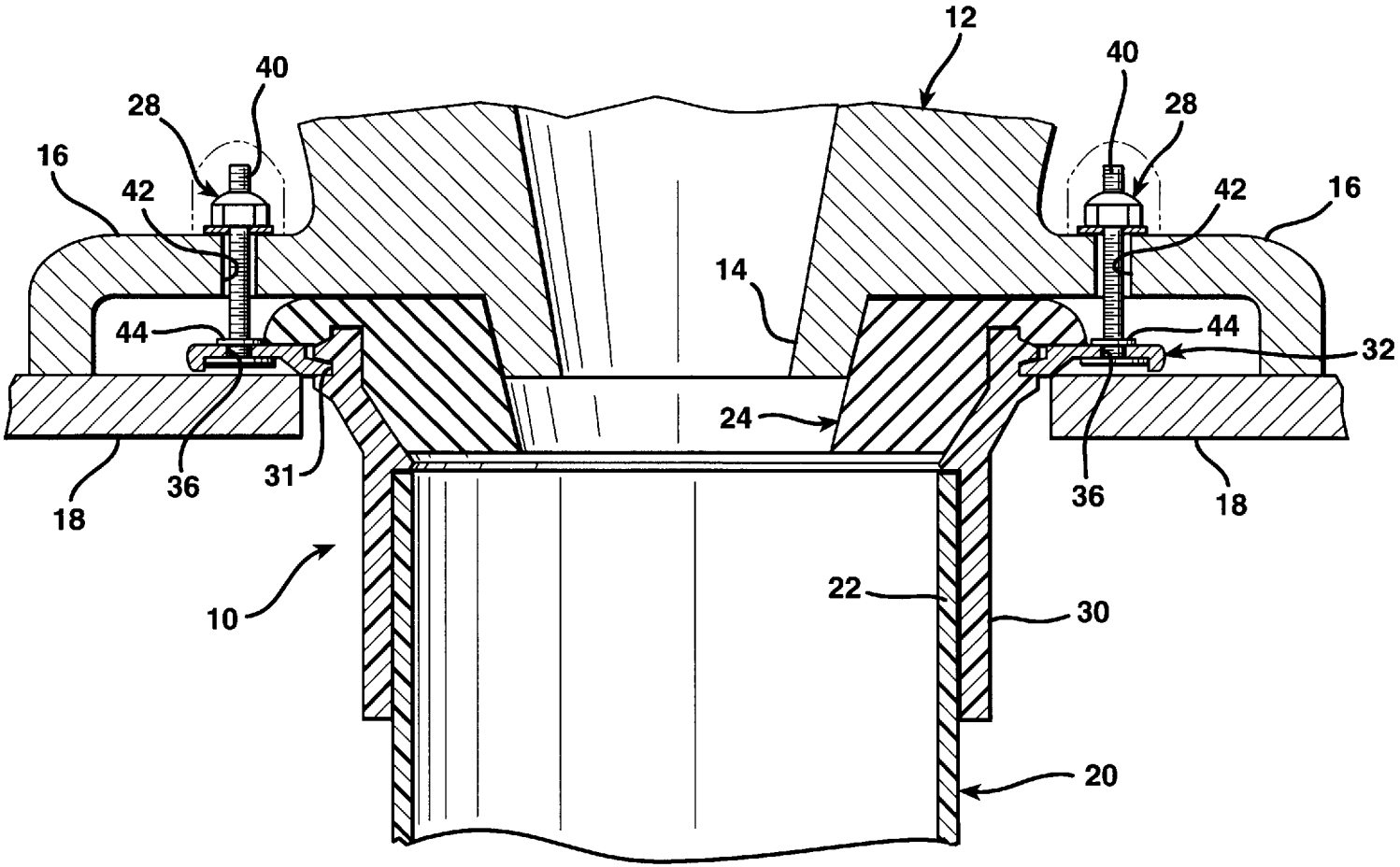
FIG. 1 PRIOR ART
FIG. 1 is a sectional elevational view illustrating the base of a toilet seated in a conventional manner.

FIG. 1 illustrates a conventional toilet seat mounting arrangement utilizing a composite plastic and steel water closet coupling illustrated generally at 10. According to conventional practice a ceramic toilet 12 is provided which defines a discharge drain 14 at the center of its underside and a base 16 projecting laterally on its opposite sides. The downwardly turned periphery of the base 16 rests upon a wooden or concrete floor 18. The toilet 12 is secured to the upper extremity 22 of a vertically oriented drain pipe 20 by means of the water closet coupling 10, a generally toroidal-shaped sealing ring 24, and closet bolts 26 and closet bolt nuts 28. The sealing ring 24 is preferably a wax bowl ring with a plastic flange on its underside.

The water closet coupling 10 is formed with a plastic tube 30 that is disposed as a sleeve about the upper extremity 22 of the toilet sewer drain pipe 20. At its upper extremity the sleeve 30 is provided with a radially inwardly projecting shoulder that resides in abutment against the top edge of the upper extremity 22 of the toilet drain pipe 20. On its outer surface the sleeve 30 defines a radially outwardly directed channel that receives the interior edge of a stamped, radially projecting steel closet flange 32. Although longitudinally restrained relative to the water closet coupling 10, the steel closet flange 32 is typically mounted so as to be freely rotatable relative to the water closet coupling sleeve 30 within the channel 31 defined therein. This construction allows the closet flange 32 to be rotated relative to the sleeve 30 of the water closet coupling 10 so as to bring the shanks 40 of the closet bolts 26 into vertical alignment with closet bolt openings 42 that are defined within the base 16 of the toilet bowl 12.

A pair of diametrically opposed, arcuate closet bolt slots 36 are formed in the steel closet flange 32 to receive the closet bolts 26. The slots 36 are widened with keyhole-shaped openings at diametrically opposed ends to receive the heads 38 of the closet bolts 26 therethrough. The heads 38 of the closet bolts 26 can be inserted through the widened regions from above, and the closet bolts 26 can then be moved laterally so that the shoulders of the heads 38 bear upwardly against the underside of the closet flange 32 on opposite sides of the narrower, arcuately-shaped portions of the closet head bolt slots 36.

It is sometimes advisable at this point to thread a light, flat sheet metal nut 44, known in the trade as a tinnerman nut, down onto the shanks 40 of the closet bolts 26 to hold the heads 38 of the closet bolts 26 in contact with the underside of the closet flange 32 while the toilet bowl 12 is being mounted atop the upper extremity 22 of the toilet drain 20. The retaining nuts 44 also serve to prevent the heads 38 of the closet bolts 26 from turning during subsequent tightening of the closet bolt nuts 28.

The closet bolts 26 can be moved laterally within the confines of the arcuately-shaped portions of the closet bolt slots 36, and the closet flange 32 can be rotated relative to the water closet coupling sleeve 30 so as to permit the closet bolt shanks 40 to be brought in accurate vertical registration with the closet bolt openings 42 in the toilet bowl base 16 as the toilet bowl 12 is lowered into position. Once the toilet bowl 12 has been lowered into position with the toilet drain 14 coaxially aligned with the upper extremity 22 of the sewage drain pipe 20, the shanks 40 of the closet bolts 26 will project upwardly through the closet bolt openings 42 in the base 16 of the toilet bowl 12.

Once the base 16 rests upon the floor 18, fender washers 44 are placed onto the upwardly protruding extremities of the closet bolt shanks 40. The closet bolt nuts 28 are thereupon engaged with the threaded distal, upwardly directed extremities of the closet bolt shanks 40 and are tightened downwardly thereon. As the closet bolt nuts 28 are tightened onto the closet bolt shanks 40, the wax ring 24 is compressed between the water closet coupling 10 and the underside of the toilet bowl 12 to form a fluid-tight and gas-tight seal between the toilet bowl 12 and the sewage drain pipe 20. The base 16 of the toilet bowl 12 rests firmly upon the floor 18. The installation of the toilet bowl 12 is thereupon complete.

However, not infrequently the metal structure of the closet ring flange 32 will deteriorate with time and become rusted and corroded. In particular the structure of the closet flange 32 will corrode and deteriorate along side of the closet bolt slots 36 to the point where there is no structure left against which the shoulders of the closet bolt heads 38 can bear. When this occurs the heads 38 of the closet bolts 26 pull through the structure of the closet flange 32. As a result, the toilet bowl base 16 will rock relative to the floor 18, and the toilet 12 can twist atop the water closet coupling 10. Furthermore, this leads to a loss of integrity of the seal formed by the sealing ring 24.

Because the sleeve 30 of the water closet coupling 10 is solvent welded to the upper extremity 22 of the sewage pipe 20, it is extremely difficult to replace the entire water closet coupling 10. Furthermore, the loss of structural integrity of the steel closet flange 32 is often so severe and extensive that a spanning strip, such as that described in U.S. Pat. No. 4,207,630 cannot be utilized as there is simply an inadequate amount of structure remaining of the closet flange 32 to provide a sufficient bearing surface for such a spanning strip. This problem has existed for quite a number of years. However, the problem is solved using the unique repair system of the invention.

Figure 2:
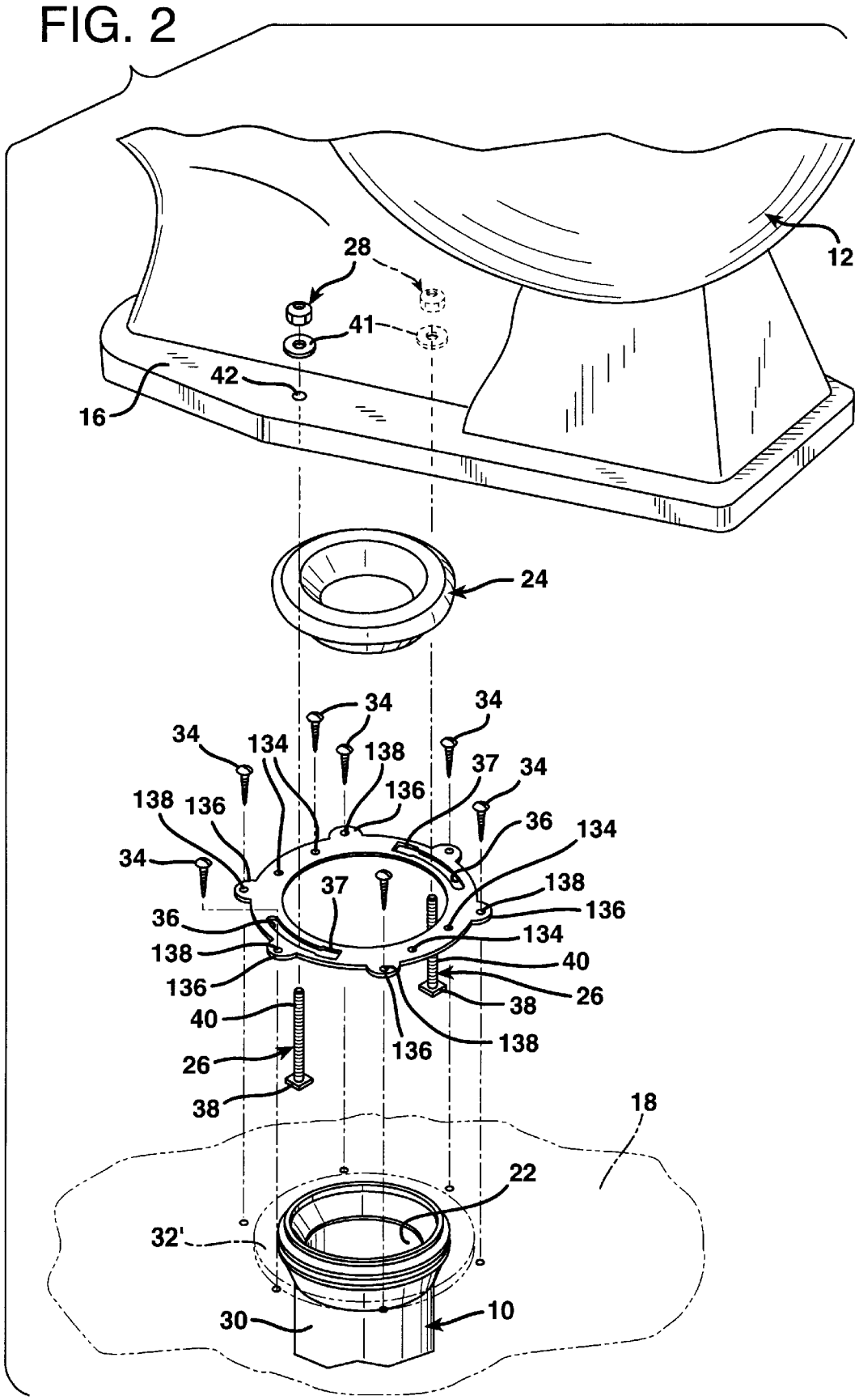
FIG. 2 is an exploded perspective view illustrating the method of reseating a toilet according to the present invention.
Figure 3:
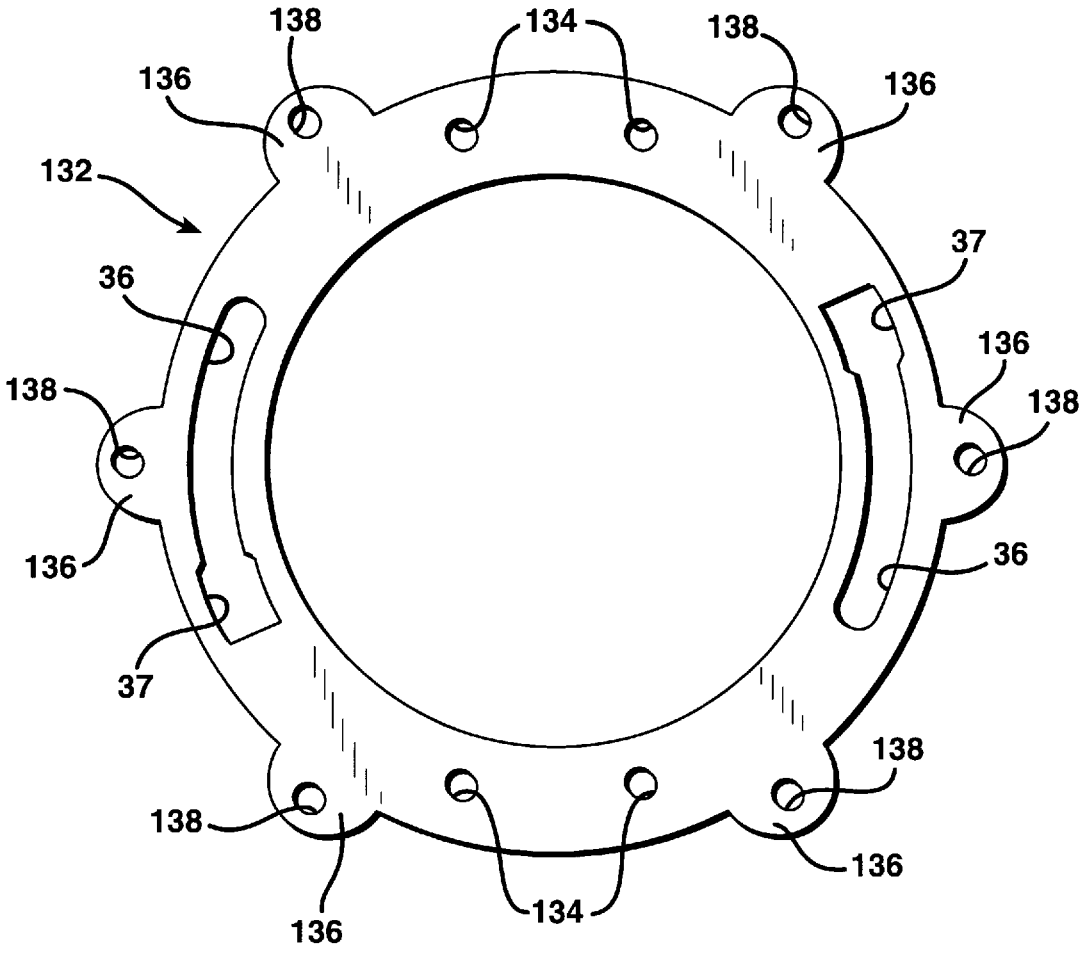
FIG. 3 is a top plan view of a flat annular structure employed in the implementation of the method illustrated in FIG. 2.

When the closet flange 32 has disintegrated and become so corroded as to provide inadequate structural support for seating the toilet 12, it is advisable, according to the system of the invention, to remove any remnant portions of the closet flange 32 that may remain attached to the water closet coupling sleeve 30. In most instances where the closet ring 32 has deteriorated, this can usually be performed without great difficulty utilizing a hammer, pliers, or a screwdriver. The closet ring flange 32 is thereupon removed entirely from the space which it previously occupied, indicated at 32' in FIG. 2.

According to the invention, a flat, rigid member that is arcuately curved to conform to the outer circumference of the drain sleeve 30 is provided to allow implementation of the necessary repair. This flat member may take the form of a flat, annular replacement ring 132, as illustrated in FIGS. 2 through 7. Like the closet flange 32, the annular replacement ring 132 is preferably formed with a pair of elongated, arcuate slots 36 having keyhole openings 37 identical to those that were originally provided in the closet flange 32. The slots 36 preferably can accommodate both one-quarter and five-sixteenth of an inch diameter closet bolts. Also, the flat, annular ring 132 is additionally provided with a plurality of interior anchor fastening openings 134 that are spaced the same radial distance from the axial center of the ring 132 as the closet bolt slots 36, but in angular displacement therefrom. The interior anchor fastener openings 134 may, for example, be angularly displaced from the ends of the closet bolt slots 36 between about twenty and forty-five degrees.

In addition to the interior anchor fastening openings 134, the replacement ring 132 is also provided with a plurality of radially projecting flat, generally semicircular ears 136 that extend radially outwardly from the otherwise circular, annular outer perimeter of the ring 132. A distance of about one half an inch. An outer anchor fastener opening 138 is defined in each of the radially projecting ears 136. The outer anchor fastener openings 138 are therefore located at a greater radial distance from the center of the ring 132 than the inner anchor fastener openings 134.

The annular ring 132 preferably has a nominal outer circular diameter from which the ears 136 project of about seven inches and a nominal inner circular diameter of about five and one-quarter inches. The annular ring 132 is preferably formed of steel about one-eighth of an inch in thickness. The steel structure is preferably dipped in a molten, corrosion-resistant substance, such as plastisol after being stamped from flat, sheet metal stock. The ring 132 therefore is covered with a corrosion-resistant plastisol coating prior to use. The coating insures long lasting corrosion protection to avoid subsequent repair.

According to one implementation of the method of the invention, the toilet 12 is first removed from its seated position atop a corroded, broken, or deteriorated closet flange 32 and the old sealing ring 24 is also removed. Preferably any remnant portions of the original steel closet flange 32 are removed from the sleeve 30. If the old closet bolts 26 are corroded, they are removed from the toilet base and discarded. In any event, undamaged closet bolts 26 are then inserted into the closet bolt slots 36 in the ring 132 such that the closet bolt heads 38 bear upwardly against the underside of the structure of the replacement ring 132 on both sides of the closet bolt slots 36 such that the closet bolt shanks 40 project through the closet bolt slots 36. If desired, tinnerman nuts can be advanced onto the shanks 40 of the closet bolts 26 to hold the closet bolt heads 38 in contact with the underside of the replacement ring 132 while the toilet 12 is being reseated.

Figure 4:
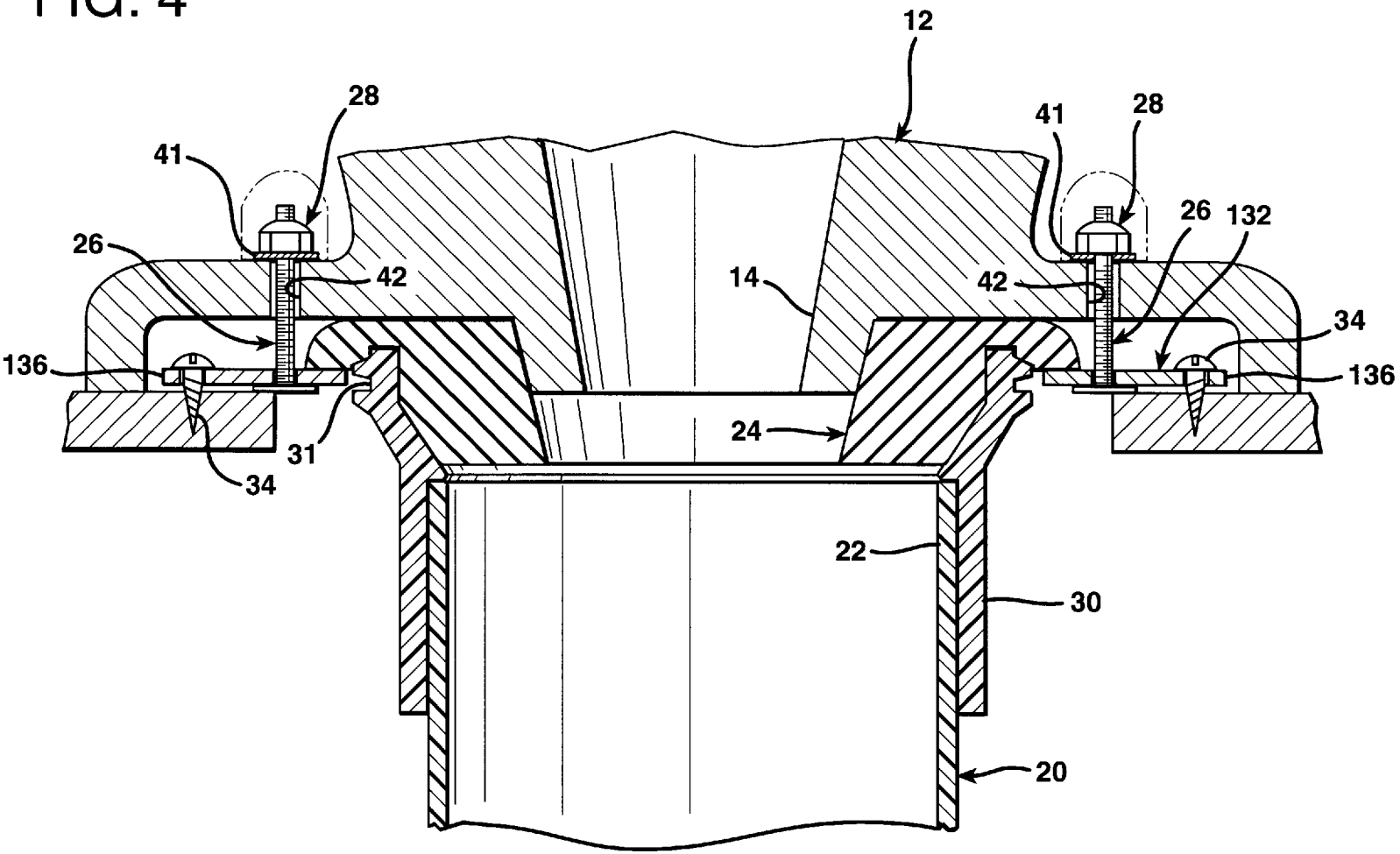
FIG. 4 is a sectional elevational view illustrating one manner of implementation of the method of FIG. 2.

The flat replacement ring 132 is then placed upon the floor 18 adjacent the upper extremity 22 of the sewage drain 20 coaxially surrounding the sleeve 30 in longitudinal alignment with the channel 31, as illustrated in FIG. 4. The replacement ring 132 thereby occupies the position previously occupied by at least a portion of the original closet flange 32, although the replacement ring does not extend into the channel 31.

In positioning the replacement ring 132 on the floor 18, the location of the closet bolt openings 42 in the toilet base 16 relative to the floor 18 should be noted so that the closet bolt slots 36 in the replacement ring 132 can be positioned in vertical registration therewith. The length of the arcuate bolt slots 36 in the replacement ring 132 allows for some centering of the toilet 12.

The replacement ring 132 is thereupon secured to the wood or concrete subfloor 18 by means of wood screws 34 which serve as anchor fasteners in the wood floor illustrated in FIG. 4. Concrete anchors are substituted for the wood screws 34 when the replacement ring 32 is to be fastened to a concrete floor.

The replacement ring 132 is versatile and adaptable to accommodate many different installation situations. Specifically, the replacement ring 132 can be attached to the floor 18 by using anchoring fasteners 34 extending through either the outer anchor fastener openings 138 the inner anchor fastener openings 134, or both the outer and inner anchor fastener openings 138 and 134, depending upon the situation confronting the plumber. For example, if the floor opening is relatively large so that there is no subfloor structure directly beneath the inner anchor fastener openings 134, the replacement ring 132 can be fastened to the floor 18 by means of the wood anchor screws 34 through the outer anchor fastener openings 138 in the radially projecting ears 136 as depicted in FIG. 4.

Once the anchor fasteners 134 have been secured to the floor 18, the closet bolt heads 38 will typically be held firmly against the floor 18 so that the shanks 40 of the closet bolts 26 extend vertically upwardly in alignment with the closet bolt openings 42 in the toilet base 16. A new sealing ring 24 is then inserted about the outer surface of the toilet drain 14 and the toilet 12 is then lowered into position in the manner depicted in FIG. 2.

Once the toilet base 16 rests upon the floor 18, the distal upper extremities of the shanks 40 of the closet bolts 26 project above the upper surface of the base 16. Fender washers 40 are thereupon installed about the exposed upper extremities of the closet bolt shanks 40, and closet bolt nuts are then engaged on the protruding distal extremities of the shanks 40 and tightened. As the closet nuts 28 are tightened down onto the distal ends of the closet bolt shanks 40 they exert a compressive force on the sealing ring 24 to seal the sealing ring 24 to both the toilet drain 14 and to the inner surface of the original water closet coupling sleeve 30 at the upper extremity 22 of the sewage drain 20. Typically the sealing ring 24 will be deformed and forced out over the upper extremity of the sleeve 30 and onto the inner periphery of the replacement ring 132 as illustrated in FIG. 4.

Figure 5:
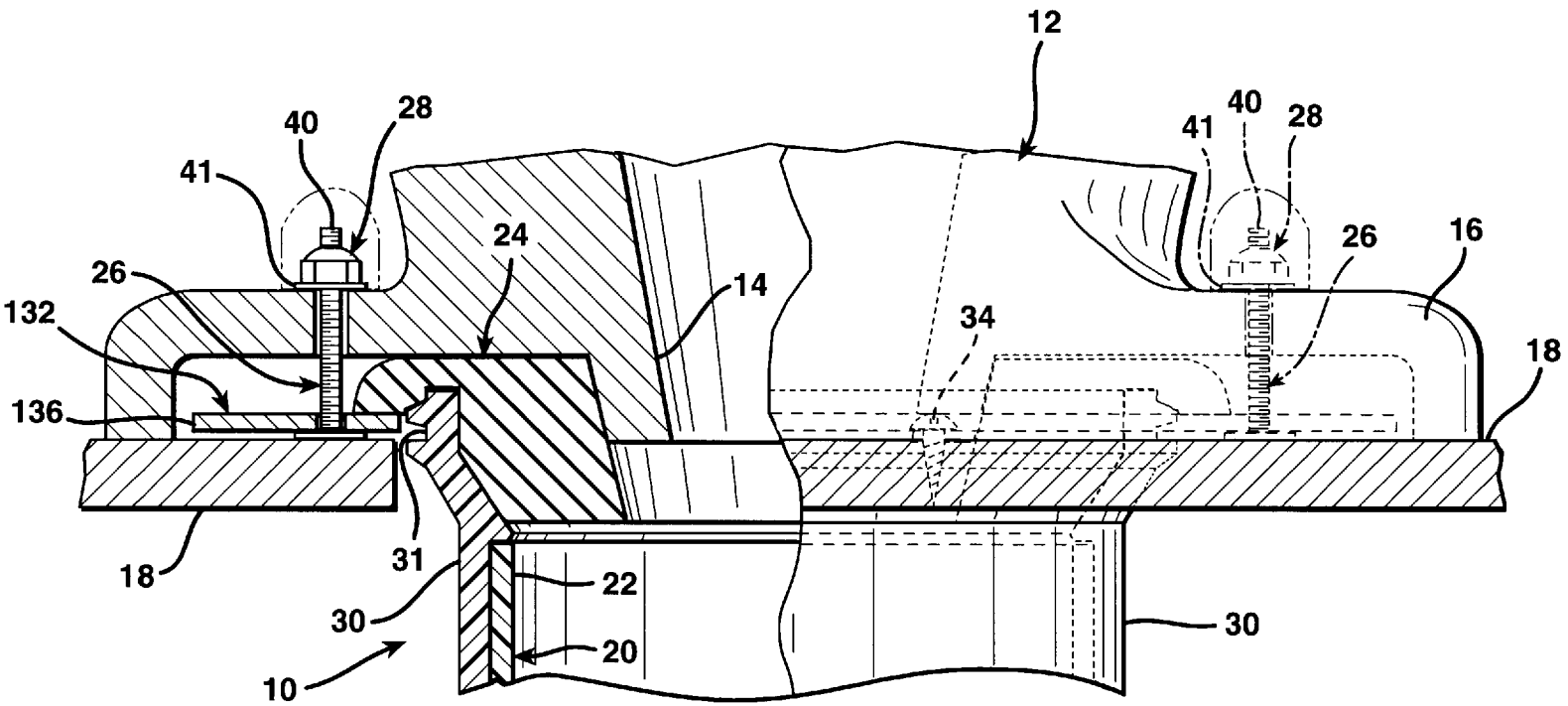
FIG. 5 is an elevational view, partially in section, illustrating an alternative manner of implementation of the method of the invention depicted in FIG. 2.

In effectuating reseating of a toilet according to the invention, numerous different situations will sometimes face the plumber performing the task at hand. For example, as illustrated in FIG. 4 the opening in the floor 18 may be relatively large so that it is advisable to fasten the replacement ring 132 to the floor 18 by inserting the anchoring screws 34 through the outer anchor fastener openings 138 in the ears 136. On the other hand, the opening in the floor 18 for the upper extremity 22 of the sewage pipe 20 may be relatively small, in which case the anchor fasteners 34 can be secured to the floor 18 through the inner ring of anchor fastener openings 134, as illustrated in FIG. 5. Also, where the laterally projecting ears 136 project out over materials such as ceramic tile which would make installation of anchor fasteners therethrough difficult, the anchor fasteners 34 can be secured to the floor 18 through the inner fastener openings 134.

Figure 6:
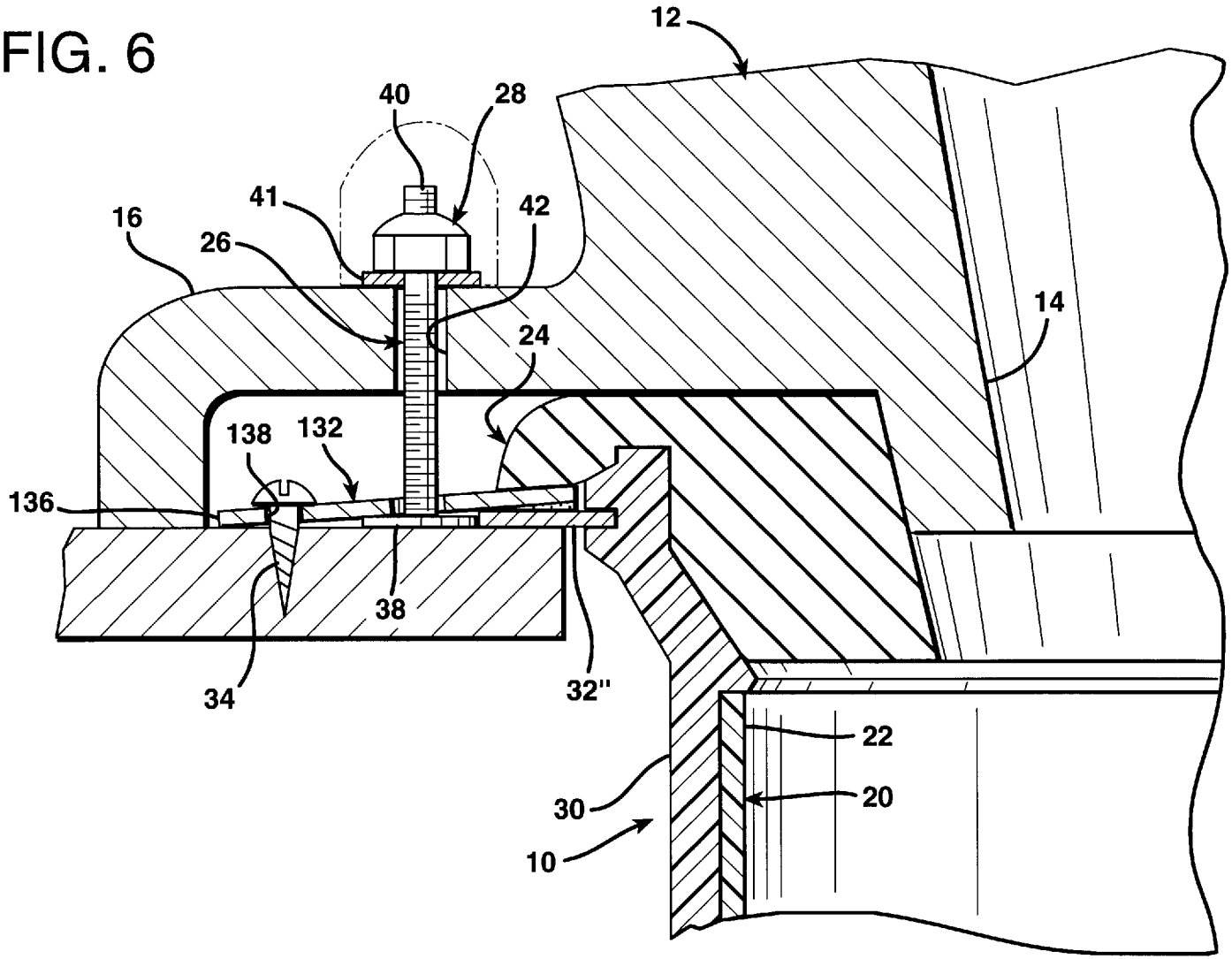
FIG. 6 is a sectional elevational detail illustrating still another alternative manner of implementation of the method of the invention.

Furthermore, in some cases the removal of the entire original closet flange 32 may appear to the plumber to be too difficult or likely to result in damage to the water closet coupling sleeve or sewage drain. Under such circumstances the plumber will then remove as much of the corroded structure of the original water closet flange 32 as seems prudent. However, it may well be that a narrow, inner annular remnant 32" of the original closet flange 32 may remain, as illustrated in FIG. 6. Indeed, it may be that a considerable portion 32" of the original closet flange structure may still exist where the only deteriorated portion is the structure adjacent one or more of the closet bolt slots 36 in the original ring 32.

In such circumstances a bead of caulking such as butyl rubber may be applied to the underside of the flat replacement ring 132 where the replacement ring 132 is to make contact with the remnant portion 32" of the original closet flange 32. The plumber then presses the replacement ring 132 down directly on top of the remnant portion 32" of the original ring 32. The caulking establishes a fluidtight seal therewith. The replacement ring 132 is then secured to the floor with fasteners 34 and the toilet 12 is then seated atop the replacement ring 132. The shanks 40 of the closet bolts 26 thereupon project upwardly through the closet bolt openings 42 in the closet base 16. The washers 40 and closet bolt nuts 28 are then installed in the manner previously described.

Figure 7:
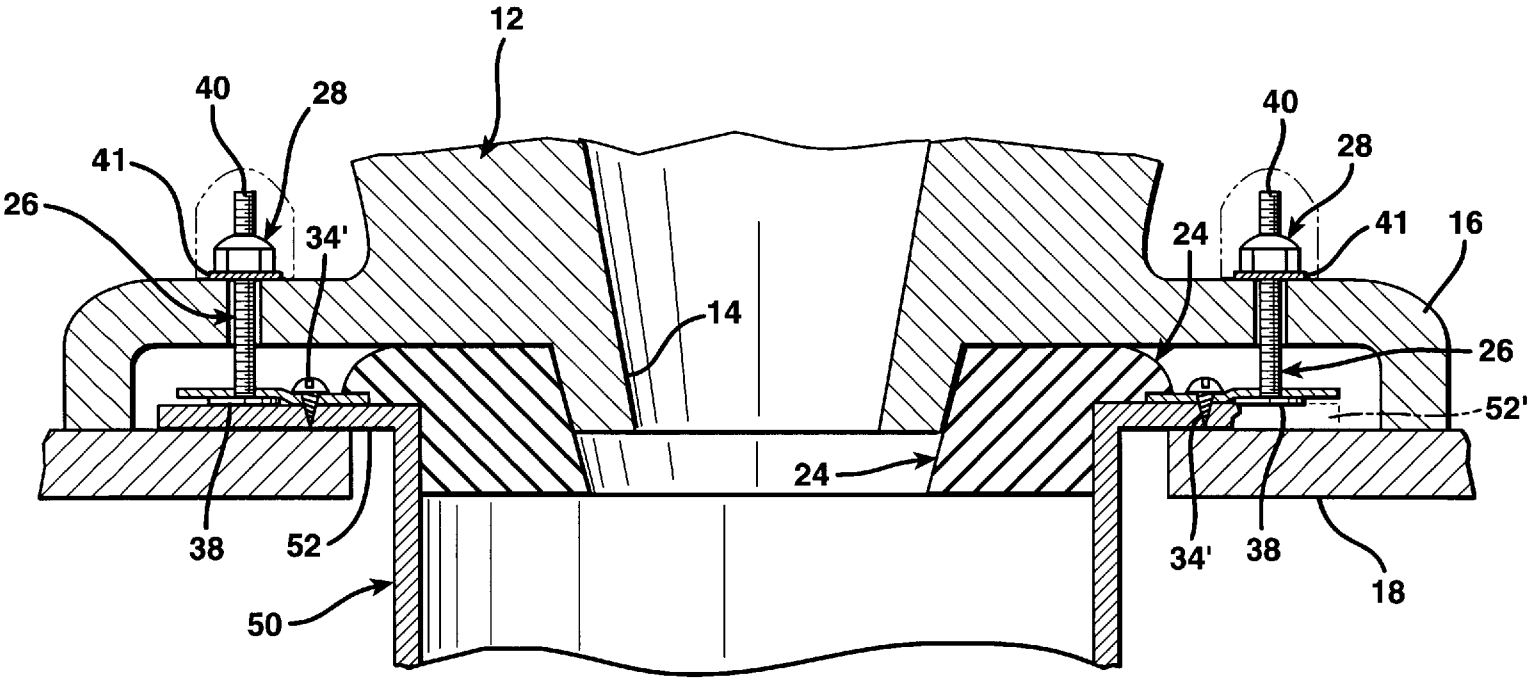
FIG. 7 is a sectional elevational view illustrating still another method of implementation of the invention.

The system of the invention is adaptable for use on cast iron water closet couplings 50 as well as on the more modern composite steel and plastic combination water closet couplings 10. The use of a replacement ring 132 in this manner is depicted in FIG. 7. When there is a failure in a cast iron closet flange 52, that failure typically occurs as a fracture which breaks away only a portion or segment of the cast iron closet flange 52, such as from the area indicated in phantom at 52' in FIG. 7. With a cast iron water closet coupling 50, the fracture of a section from the area 52' is considerably more likely than a general deterioration of the closet ring 50 throughout its entire structure, as so frequently occurs with the plastic and steel composite water closet couplings 10 of the type depicted in FIGS. 1–6. However, the method of the invention and the replacement ring 132 utilized therewith are also applicable to the reseating of a toilet atop a cast iron closet ring flange 52 broken as illustrated in FIG. 7.

In such a situation where there is still a considerable amount of undeteriorated structure of the original closet flange 52, the replacement ring 132 can be mounted directly on top of the remnant portion of the old cast iron closet flange 52. The replacement ring 132 is first positioned directly on top of the remnant portion of the cast iron closet flange 52 in such an orientation that the slots 36 of the replacement flange 132 are vertically aligned with the positions of the slots 36 in the original closet flange 52. Marks are made through the anchor fastener openings 134 onto the closet flange 52 beneath the replacement ring 132 through those openings 134 beneath which structure of the closet flange 52 still exists.

The replacement flange 132 is then lifted from the original closet flange 52. Vertical holes are drilled down into the remaining structure of the closet flange 52 at the marked locations. The closet bolts 26 are then inserted through the slots 36 of the replacement flange 132 and held thereto in the manner previously described. A bead of butyl rubber calk is applied to the underside of the replacement ring 132 throughout the area thereof that is to make contact with the remnant of the original cast iron closet flange 52. Large gaps or spaces around or underneath the closet ring can be filled with any quick-setting type grout or cement. The replacement flange 132 is then again positioned atop the remnant portion of the original closet flange 52 with the openings 134 aligned with the openings in the original closet flange 52 just drilled. Self-tapping screws 34' are then screwed down through the openings 134 and into the drilled openings in the remnant of the closet flange 52' to firmly secure the replacement ring 132 atop the remnant of the original closet flange 52.

Once the replacement ring 132 has been attached to the remnant of the original closet flange 52, a new sealing ring 24 is installed. The toilet 12 is then lowered into position and the washers 40 and closet bolt nuts 28 are then secured to the distal ends of the closet bolt shanks 40 as previously described.

Figure 8:
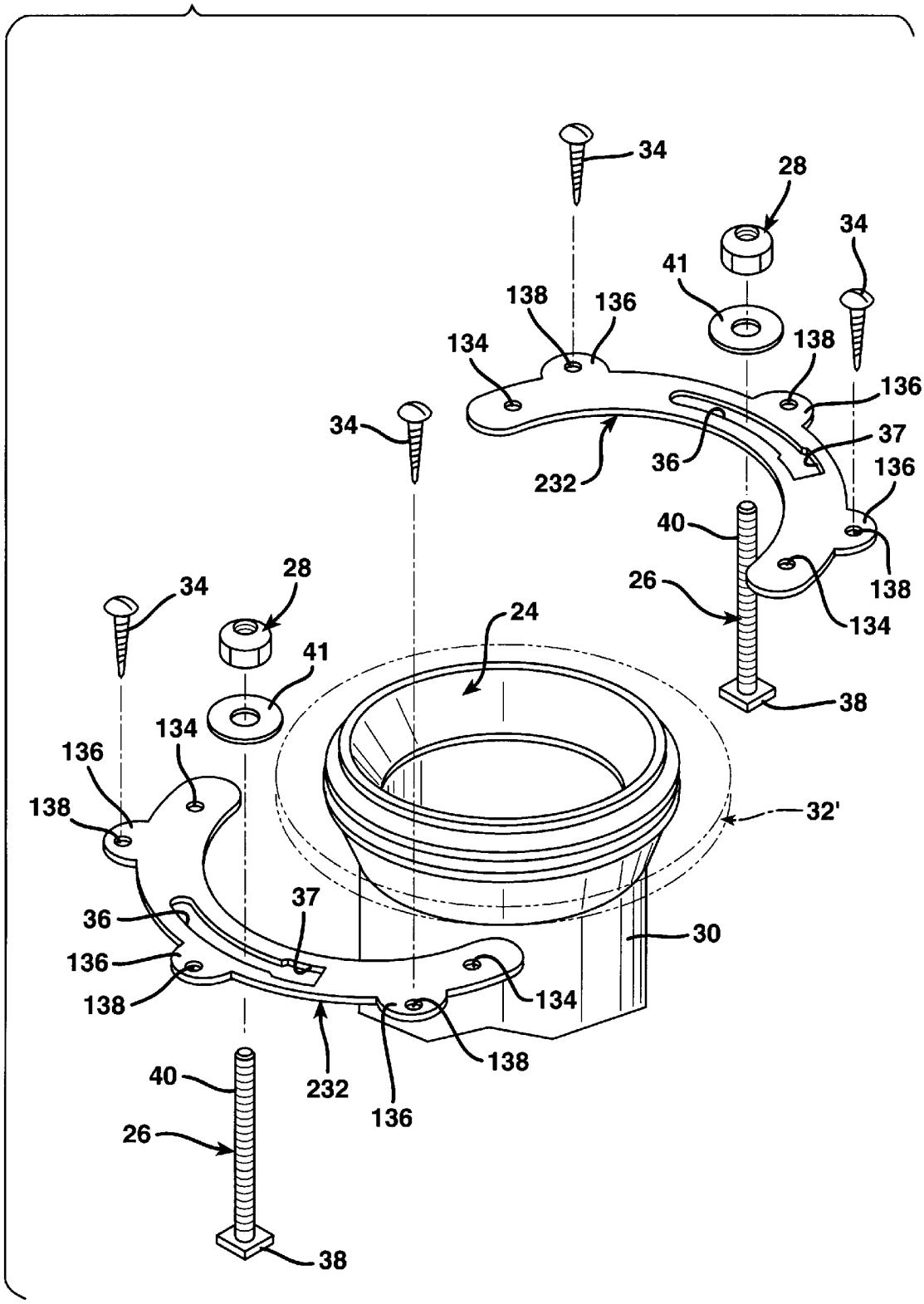
FIG. 8 is a exploded perspective view illustrating implementation of the method of the invention utilizing structures alternative to those depicted in FIG. 2.

The flat member utilized to reseat the toilet 12 need not necessarily be formed as an annular ring. For example, one or a pair of flat, arcuately curved, generally semicircular members 232 may be employed as illustrated in FIG. 8. Each of the members 232 corresponds to approximately one-half of the single flat angular member 132 depicted in FIG. 2. The closet bolt slots 36, inner anchor fastener openings 134, and outer radially projecting ears 136 and outer anchor fastener openings 138 are identical to those described in conjunction with use of the flat annular member 132. The only difference is that the system shown in FIG. 8 can be used to replace only a single side of an original closet flange 32, rather than both sides. However, like the annular replacement ring 132, the arcuate strips 232 are deployed in place of or on top of the original closet flange 32 in the manner previously described.

Undoubtedly, numerous variations and modifications of the invention will become readily apparent to those familiar with the installation and repair of plumbing fixtures. For example, the closet bolt slots 36 of the closet repair devices 132 and 232 need not necessarily have enlarged keyhole openings 37 at ends thereof since the closet bolts 26 are inserted through the slots 36 before the flat members 132 and 232 are installed atop the upper extremity 22 of the drain pipe 20. Therefore, the slots 36 in the flat, repair member used in the method of the invention can be of uniform width throughout. Other modifications of the invention are also possible. Accordingly, the scope of the invention should not be construed as limited to this specific implementations of the method described.

I claim:

1. A method of reseating a toilet having a base with closet bolt openings therein on a floor atop an upper extremity of a drain from which at least a portion of a radially projecting closet flange is missing utilizing a sealing ring, a closet bolt having an enlarged head at one end with a shank projecting therefrom to terminate in a distal end and a closet bolt nut engageable with said distal end of said shank, a plurality of anchor fasteners, and a completely flat, rigid member arcuately curved to conform to the outer circumference of said drain and having a plurality of anchor fastener openings therethrough as well as at least one elongated closet bolt slot, comprising the steps of:

inserting said closet bolt into said closet bolt slot such that said closet bolt head bears against the structure of said flat member and said closet bolt shank projects through said closet bolt slot, placing said flat member atop said floor adjacent said upper extremity of said drain such that said closet bolt shank projects upwardly, securing said flat member to said floor by means of said plurality of anchor fasteners that extend into said floor through at least some of said anchor fastener openings, positioning said sealing ring beneath said toilet, mounting said toilet atop said upper extremity of said drain so that said sealing ring is compressed therebetween and laterally adjusting the position of said closet bolt such that said closet bolt shank resides in registration with and projects upwardly through one of said closet bolt openings in said base, and tightening down said closet bolt nut onto said distal end of said closet bolt shank to thereby exert a compressive force on said sealing ring to seal said sealing ring to said toilet and to said upper extremity of said drain.

2. A method according to claim 1 further comprising positioning said completely flat, rigid member such that said closet bolt slot and at least some of said anchor fastener openings are located at a common radial distance from said upper extremity of said drain and securing at least some of said anchor fasteners to said floor at the same radial distance from said upper extremity of said drain as said closet bolt and in angular displacement therefrom.

3. A method according to claim 1 further comprising positioning said completely flat, rigid member such that at least some of said anchor fastener openings are located in said flat member at a greater radial distance from said upper extremity of said drain then said closet bolt slot, and securing at least some of said anchor fasteners to said floor at locations more distant from said upper extremity of said drain than the location of said closet bolt.

4. A method according to claim 1 wherein said flat member is placed to occupy a position previously occupied by at least a portion of said closet flange.

5. A method according to claim 1 wherein said flat member is placed atop a remnant portion of said closet flange.

6. A method according to claim 1 further comprising applying a bead of caulking to said flat member on a side thereof facing toward said floor.

7. A method according to claim 1 further comprising covering said flat member with a corrosion resistant coating prior to use.

8. A method of reseating a toilet having a base with closet bolt openings therein on a floor atop an upper extremity of a drain from which at least a portion of a radially projecting closet flange is missing utilizing a sealing ring, a pair of closet bolts each having an enlarged head at one end with a shank projecting therefrom to terminate in a distal end and a pair of closet bolt nuts engageable with said distal end of said shanks, a plurality of anchor fasteners, and a single, completely flat, rigid annular member formed of unitary construction from a sheet of flat, rigid stock so that said single, annular member is complete open at its center and is shaped as an encircling ring arcuately curved to conform to the outer circumference of said drain and having a plurality of anchor fastener openings therethrough as well as a pair of elongated closet bolt slots defined therein, comprising the steps of:

inserting said closet bolts into said closet bolt slots such that said closet bolt heads bear against the structure of said flat member and said closet bolt shanks project through said closet bolt slots, placing said single, annular member atop said floor to encircle said upper extremity of said drain and such that said closet bolt shanks project upwardly, securing said flat member to said floor by means of said plurality of anchor fasteners so that said anchor fasteners extend into said floor through at least some of said anchor fastener openings, positioning said sealing ring beneath said toilet, mounting said toilet atop said upper extremity of said drain and laterally adjusting the positions of said closet bolts such that said closet bolt shanks reside in registration with and project upwardly through said closet bolt openings in said base, and tightening down said closet bolt nuts onto said distal ends of said closet bolt shanks to thereby exert a compressive force on said sealing ring to seal said sealing ring to said toilet and to said upper extremity of said drain.

9. A method according to claim 8 further comprising seating said single, annular member atop a remnant portion of said radially projecting closet flange.

10. A method according to claim 8 further comprising applying a bead of caulking to a side of said single annular member facing said floor.

11. A method according to claim 8 further comprising removing all remnant portions of said closet flange that project radially beyond said upper extremity of said drain and placing said single, annular member atop said floor in a position previously occupied by at least a portion of said close flange.

12. A method according to claim 8 further comprising as a preliminary step sealing all exposed surfaces of said flat annular member with a corrosion resistant coating.

13. A method of securing a water closet having closet bolt openings therein to a drain, the upper extremity of which has a broken water closet flange at least a portion of which remains intact, utilizing an annular sealing ring, at least one arcuately curved rigid flat replacement member formed in the shape of at least a portion of a water closet flange and having a plurality of anchor fastener openings therein and at least one elongated, enclosed slot therein, at least one closet bolt having an enlarged head and a shank projecting therefrom and terminating at a distal end, and at least one closet bolt nut engageable with said distal and of said closet bolt shank comprising:

inserting said closet bolt into said elongated slot such that said closet bolt head bears upwardly against said completely flat replacement member from beneath and said closet bolt shank projects upwardly through said closet bolt slot, positioning said flat replacement member atop said portion of said broken water closet flange that remains intact and adjacent said upper extremity of said drain with said closet bolt shank projecting upwardly therefrom, securing said flat replacement member to said portion of said water closet flange remaining intact with anchor fasteners that project through said anchor fastener openings therein and into said portion of said water closet flange remaining intact, positioning said sealing ring beneath said water closet, mounting said water closet atop said flat replacement member and adjusting the position of said closet bolt along said elongated slot so that said distal end of said closet bolt shank projects upwardly and protrudes through one of said closet bolt openings in said water closet, and tightening a closet bolt nut down onto said distal end of said closet bolt shank thereby compressing said sealing ring to seal it to said upper extremity of said drain and to said water closet.

14. A method according to claim 13 wherein said flat replacement member is formed as a single, annular ring with a pair of elongated slots defined therein as aforesaid from a sheet of flat, rigid stock so that said single, annular member is completely open at its center and is shaped as an encircling ring, and further comprising inserting a pair of closet bolts as aforesaid, one into each of said elongated slots.

* * * * *

UNITED STATES PATENT AND TRADEMARK OFFICE

CERTIFICATE OF CORRECTION

PATENT NO : 5,890,239

DATED : April 6, 1999

INVENTOR(S) : Mike Hite

It is certified that error appears in the above-identified patent and that said Letters Patent is hereby corrected as shown below:

On the cover page the Notice of Patent Term Extension is hereby corrected to read as follows:

Notice: Under 35 U.S.C. 154(b) the term of the patent shall be extended for 109 days.

At col. 6, line 48 the word "the" is deleted and the word "be" is substituted in place thereof.

In Claim 13, col. 14, line 58 the word "completely" is inserted before the word "flat" and removed from before the word "flat" where it bridges col. 14, line 67 and col. 15, line 1.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*